US008146456B1

(12) United States Patent
Rankin

(10) Patent No.: US 8,146,456 B1
(45) Date of Patent: Apr. 3, 2012

(54) PRECISION CRANKSHAFT ROTATING APPARATUS AND METHOD OF CRANKSHAFT ROTATION

(75) Inventor: Brent Rankin, Lima, OH (US)

(73) Assignee: Honda Motor Co., Ltd., Tokyo (JP)

( * ) Notice: Subject to any disclaimer, the term of this patent is extended or adjusted under 35 U.S.C. 154(b) by 440 days.

(21) Appl. No.: 12/057,085

(22) Filed: Mar. 27, 2008

(51) Int. Cl.
*G05G 1/04* (2006.01)

(52) U.S. Cl. ..... 74/519

(58) Field of Classification Search ..... 74/15.63, 74/519, 523, 543, 545, 548, 550, 595; 73/115.01, 73/115.05, 116
See application file for complete search history.

(56) References Cited

U.S. PATENT DOCUMENTS 3,763,420 A * 10/1973 Maisonville ..... 324/392
4,580,446 A 4/1986 Ansteth
4,782,692 A 11/1988 Peden et al.
4,922,749 A 5/1990 Steffes et al.
5,460,138 A * 10/1995 Hasegawa ..... 123/179.3
6,253,600 B1 * 7/2001 Sondey ..... 73/116.02
6,450,072 B1 9/2002 Koester
7,152,465 B2 12/2006 Candeo
7,726,182 B1 * 6/2010 Newlin et al. ..... 73/116.02
2002/0157649 A1 * 10/2002 Zimmermann et al. ..... 123/478

* cited by examiner

*Primary Examiner* — Vicky Johnson
(74) *Attorney, Agent, or Firm* — Standley Law Group LLP

(57) ABSTRACT

An apparatus and its method of use for precisely rotating a crankshaft to one or more desired angular positions. The apparatus may include a controller that is programmed to automatically rotate the crankshaft to said one or more positions, or positional control may be allocated to a user of the apparatus. Rotation of the crankshaft is accomplished using a motor or motor/gearbox assembly coupled to a drive element that is adapted to engage an exposed portion of a crankshaft of interest. The angular position of the motor or motor/gearbox assembly and/or the drive element, is monitored, such that the angular position of the crankshaft shaft of interest is known and may be controlled.

21 Claims, 4 Drawing Sheets

PRECISION CRANKSHAFT ROTATING APPARATUS AND METHOD OF CRANKSHAFT ROTATION

BACKGROUND

The present invention is directed to an apparatus for rotating a shaft or crankshaft. More particularly, the present invention is directed to an apparatus for precisely rotating a shaft or crankshaft, such as the crankshaft of an internal combustion engine, to one or more desired angular positions.

It is well known that internal combustion engines require the setting of various valve train components during their assembly. For example, it is typically necessary to set valve tappet clearance to ensure proper engine operation.

Whether in regard to the setting of valve tappet clearance or another valve train adjustment/setting operation, it is generally required to precisely rotate the crankshaft of such an engine in order to properly position the valve train component (s) of interest. Currently, such crankshaft rotation is typically accomplished manually, such as by an operator using a long-handled wrench adapted to engage an exposed portion of the crankshaft.

Obviously, manual rotation of an engine crankshaft is undesirable at least for ergonomic reasons, among others. In addition, it should be realized that an internal combustion engine typically has multiple cylinders, each having two or more valves. Hence, a task such as setting valve tappet clearance, for example, requires that the crankshaft of each engine be rotated numerous times throughout the overall process. It should also be realized that the crankshaft must be rotated precisely to a particular position so as to properly set the initial position of a valve train component(s) to be adjusted. This is typically accomplished during manual crankshaft rotation by rotating the crankshaft to a position that coincides with a particular marking appearing on a gauge or other alignment device. Clearly, the positioning accuracy of such a technique is limited.

The above problems are further complicated by the fact that modern internal combustion engines are being increasingly manufactured to tighter tolerances. Consequently, the clearances between valve train components (e.g., piston rings and cylinder walls) have been reduced, thereby leading to an increased resistance to crankshaft rotation. As such, manual rotation of an engine crankshaft is also becoming more difficult.

Therefore, it can be understood that what is needed is an apparatus and method for producing a precise and nonhuman powered rotation of a crankshaft. The present invention provides just such a result.

SUMMARY OF THE OF THE GENERAL INVENTIVE CONCEPT

The present invention is directed to a powered crankshaft rotation apparatus and a method of using said apparatus to precisely rotate a crankshaft to one or more desired angular positions. As described in detail herein, embodiments of an apparatus of the present invention may be used to rotate the crankshaft of an internal combustion engine. Alternatively, embodiments of the present invention may be used to rotate the shaft or crankshaft of other types of engines and/or motors.

An apparatus and method of the present invention may be used to rotate a shaft or crankshaft of an engine or motor during the assembly process thereof. Alternatively, it is possible to employ an apparatus and method of the present invention to rotate the shaft or crankshaft of a previously assembled engine or motor, such as for the purpose of making adjustments or effecting repairs.

In certain embodiments of the present invention, a crankshaft rotating apparatus may be portable in nature so that it may be moved or otherwise positioned to the shaft or crankshaft of an engine or motor of interest. Alternatively, an apparatus of the present invention may be of stationary design, such that engines or motors requiring crankshaft or shaft rotation are moved into position with respect to the apparatus. An apparatus of the present invention may be used for example, on an assembly line or in another manufacturing setting, and/or may be employed in a garage, shop or other repair facility.

An apparatus of the present invention generally includes a handle, and a body portion in association with a motor. The motor may be connected to a gearbox. The motor or motor/gearbox assembly is provided to rotate a connected drive element, which is adapted to engage an exposed end of a crankshaft of interest. Preferably, an encoder or other position sensor is provided to monitor the angular position of the motor, gearbox and/or drive element, so as to monitor and control the rotation of the shaft or crankshaft of interest.

Preferably, a controller is provided for managing operation of the apparatus. The controller is preferably, but not necessarily, microprocessor-based. The controller may be an integral part of the apparatus, or may be located remotely from the remainder of the apparatus while remaining in communication therewith. The controller allows the apparatus to precisely rotate a shaft or crankshaft of interest to one or more desired angular positions.

A portable embodiment of an apparatus of the present invention may be located along an assembly line, such as in a position suspended from a lift-assist device. When rotation of a shaft or crankshaft is required, the apparatus may be drawn toward the associated motor or engine and positioned such that its drive element engages the shaft or crankshaft. Preferably, a locking or other anti-rotation device is provided and adapted to engage with a motor or engine element, an assembly line carrier element, or some other structure that will prevent rotation of the entire apparatus when the motor thereof applies a rotating torque to the shaft or crankshaft.

Operation of an apparatus of the present invention may be initiated by pressing an activation element (e.g., a start button) or any of various other devices known to those skilled in the art. The controller may be provided with one or more sets of instructions that allow it to rotate the shaft or crankshaft to one or more predetermined angular positions. For example, the controller may be programmed to rotate a shaft or crankshaft to one or more rotational positions that are randomly selectable by an operator, or through a series of rotational positions in some particular order. An apparatus of the present invention could also be designed without programming, wherein it might be operated by the continued depression of a start button, etc. In this case, an operator would control the rotational positioning of the shaft or crankshaft.

It can be understood from the foregoing general description that various embodiments of an apparatus of the present invention are possible, and that such embodiments could be used to rotate the crankshafts of various devices. All such embodiments and methods of use are within the scope of the present invention. However, for purposes of clarity and brevity, an apparatus of the present invention is described in more detail below only with respect to the rotation of an internal combustion engine crankshaft.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 1:
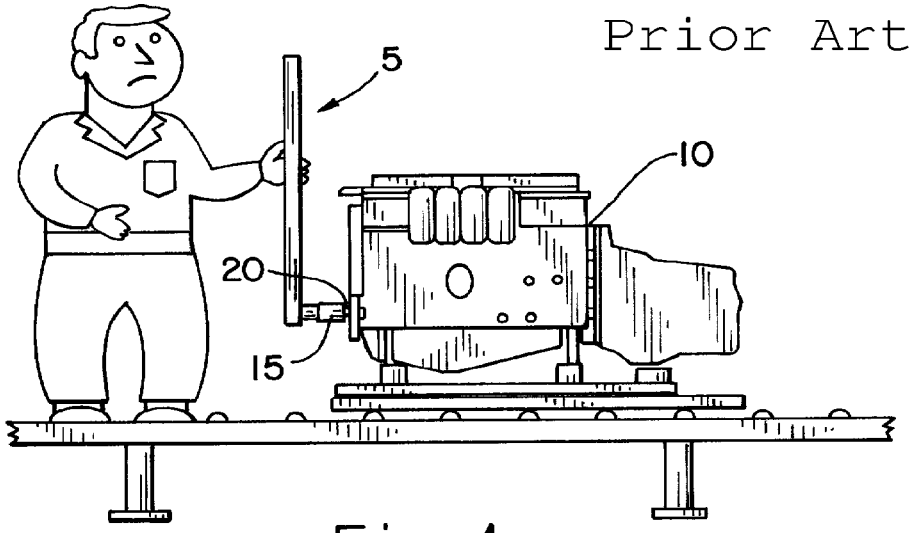
FIG. 1 is illustrates a common currently practiced technique for manually rotating the crankshaft of an internal combustion engine during the assembly thereof.

As described previously and as illustrated in FIG. 1, the manual rotation of an internal combustion engine crankshaft is typically currently accomplished by one or more operators using a long-handled wrench or similar tool 5. FIG. 1 depicts such a process in regard to an internal combustion engine 10 that is still in a state of assembly. As can be seen, the tool 5 includes a socket 15 or some other implement that is adapted to engage an exposed portion of the crankshaft 20. Once the socket 15 is engaged with the crankshaft 20, the tool 5 is used to rotate the crankshaft to a desired rotational position. A position gauge or some other suitable indicator is commonly used to assist the operator in the positioning of the crankshaft. For at least the reasons stated above, this can be understood to be an undesirable crankshaft rotation technique.

An apparatus of the present invention eliminates the need to perform crankshaft rotation in the manner illustrated in FIG. 1. One exemplary embodiment of a precision crankshaft rotating apparatus 25 ("apparatus") of the present invention can be observed in FIGS. 2*a*-2*b*.

Figure 2A:
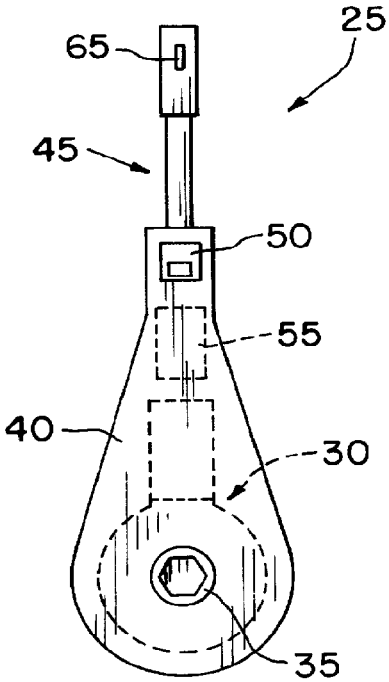
FIGS. 2*a*-2*b* show enlarged front and left side views, respectively, of an exemplary portable version of a precision crankshaft rotating apparatus of the present invention.
Figure 2B:
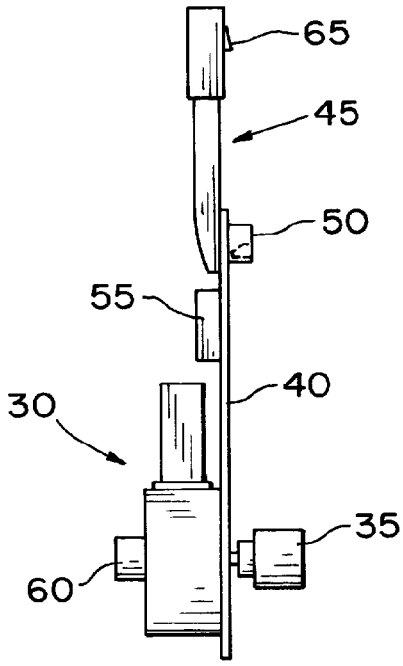

The exemplary embodiment of the apparatus shown in FIGS. 2*a*-2*b* includes a motor/gearbox assembly 30 for rotating a crankshaft of interest. In other embodiments of the present invention, it may be possible to employ a motor without a gearbox. When a gearbox is used, it may be a separate device, as shown in FIGS. 2*a*-2*b*, or a gearbox (gear reduction unit) may be integral to the motor. A drive element 35, such as for example, the drive socket shown, is associated with the motor/gearbox assembly 30 for imparting rotation to a crankshaft of interest. The drive element 35 is adapted to engage an exposed portion of a crankshaft of interest. Although the drive element 35 of this exemplary embodiment is shown to be a drive socket, it is to be understood that the use of other types of drive elements is possible, and the specific design thereof will likely depend on the configuration of the mating portion of the crankshaft to which the drive element will be engaged.

The apparatus 25 includes a plate or some other body portion 40 to which the motor/gearbox assembly 30 is mounted. As would be obvious to one skilled in the art, the body portion 40 could be of virtually any design, size, or construction, and the particular body portion shown herein is not to be construed as in any way limiting the present invention to a body portion of particular design, size and/or construction.

The apparatus 25 also includes a handle 45 for facilitating grasping and manipulation of the apparatus. As shown, the handle 45 is affixed to the body portion 40. Other points of attachment are also obviously possible. In this particular embodiment, the handle 45 is elongate and of rod-like shape, with one end attached to the body portion 40 and a free end adapted for grasping by a user of the apparatus 25. A multitude of other handle designs are also possible, as would be apparent to one skilled in the art. The use of multiple handles is also contemplated.

Figure 5:
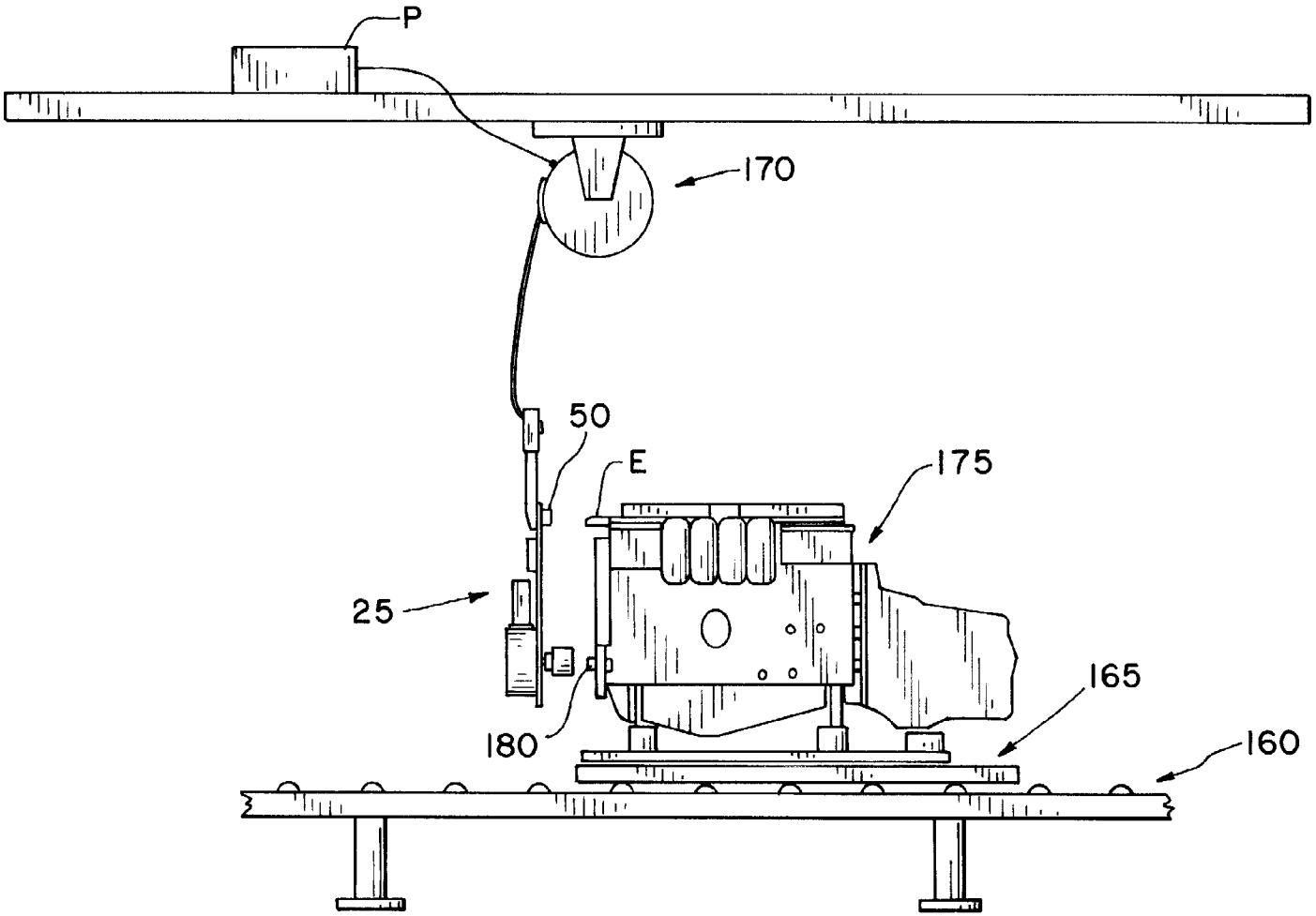
FIG. 5 depicts the apparatus of FIGS. 2*a*-2*b* located in a suspended position along an internal combustion engine assembly line.

An apparatus of the present invention also preferably, but not essentially, includes an anti-rotation element that prevents rotation of the entire apparatus when the motor/gearbox assembly thereof applies a rotating torque to a crankshaft. As shown in FIGS. 2*a*-2*b*, this exemplary apparatus 25 includes an anti-rotation element 50 that is adapted to engage an assembly line engine carrier element E (see FIG. 5). Anti-rotation elements of the present invention may also be designed to engage other elements, whether on the engine itself, on a carrier, or on some other nearby structure. Referring to FIG. 5, it can be understood that upon engagement of the anti-rotation element 50 of the apparatus 25 with the corresponding engine carrier element E, rotation of the apparatus during operation is prevented. It is also possible to construct an apparatus of the present invention without an anti-rotation device, but doing so will require a user of the apparatus to resist its rotation once the motor/gearbox assembly begins to rotate a crankshaft.

Preferably, a controller 55 is provided for managing operation of the apparatus 25. The controller 55 is preferably, but not necessarily, microprocessor-based. The controller 55 may be attached directly to the apparatus 25, as shown in FIGS. 2*a*-2*b* or, alternatively, may be located remotely from the remainder of the apparatus while remaining in communication therewith.

A position sensor 60 is also provided to monitor the angular position of the motor/gearbox assembly 30 and/or the drive element 35. While one skilled in the art would understand that there are numerous position sensors that may be employed for this purpose, this exemplary embodiment of the apparatus 25 makes use of a rotary encoder. In different embodiments of the present invention, the position sensor(s) may be a separate device, as shown in FIGS. 2*a*-2*b*, or may be integral to the motor or motor/gearbox assembly used.

The position sensor 60 is in communication with the controller 55, such that the controller is aware of the rotational position of the motor/gearbox assembly 30 and/or associated drive element 35. The controller 55 may be provided with one or more programs that allow the motor/gearbox assembly 30 to rotate a crankshaft of interest to one or more desired angular positions. For example, and without limitation, the controller 55 may instruct the motor/gearbox assembly 30 to produce a single rotation of some degrees in a desired direction, and to subsequently reset thereafter. Alternatively, the controller 55 may be programmed to provide for a number of motor/gearbox assembly 30 rotations, which may occur sequentially. In this case, the next sequenced rotation may occur upon energization of the motor/gearbox assembly 30 by a user, by a timer, etc. Many other programming schemes could also be employed, and all such schemes are within the scope of the present invention.

In an alternative, and more simplistic embodiment of the present invention, an apparatus may be constructed without a programmable controller. For example, an apparatus may be constructed such that its motor/gearbox assembly will operate as long as a switch or other activation element is engaged by an operator of the apparatus. In such an embodiment, a position gauge or some other suitable indicator may be used to assist the operator in the positioning of the crankshaft using the apparatus.

Activation of an apparatus of the present invention may be accomplished in a variety of ways. On a portable version of such an apparatus, such as the apparatus 25 illustrated in FIGS. 2*a*-2*b*, a start button 65 or other suitable activation element is preferably provided. As shown, the start button 65 of this particular embodiment is located in the handle 45 for convenience. It should be realized, however, that the start button 65 or other activation element could be located elsewhere on the apparatus 25, and/or remotely therefrom.

In programmable embodiments of the present invention, depression of the start button 65 will typically cause the motor/gearbox assembly 30 to rotate a crankshaft of interest to some predetermined rotational position. Rotation of a crankshaft to the desired position may only require temporary depression of the start button 65. Alternatively, it may be required that the start button be continuously depressed until the programmed crankshaft position is reached and the motor/gearbox assembly 30 automatically stops.

Figure 3:
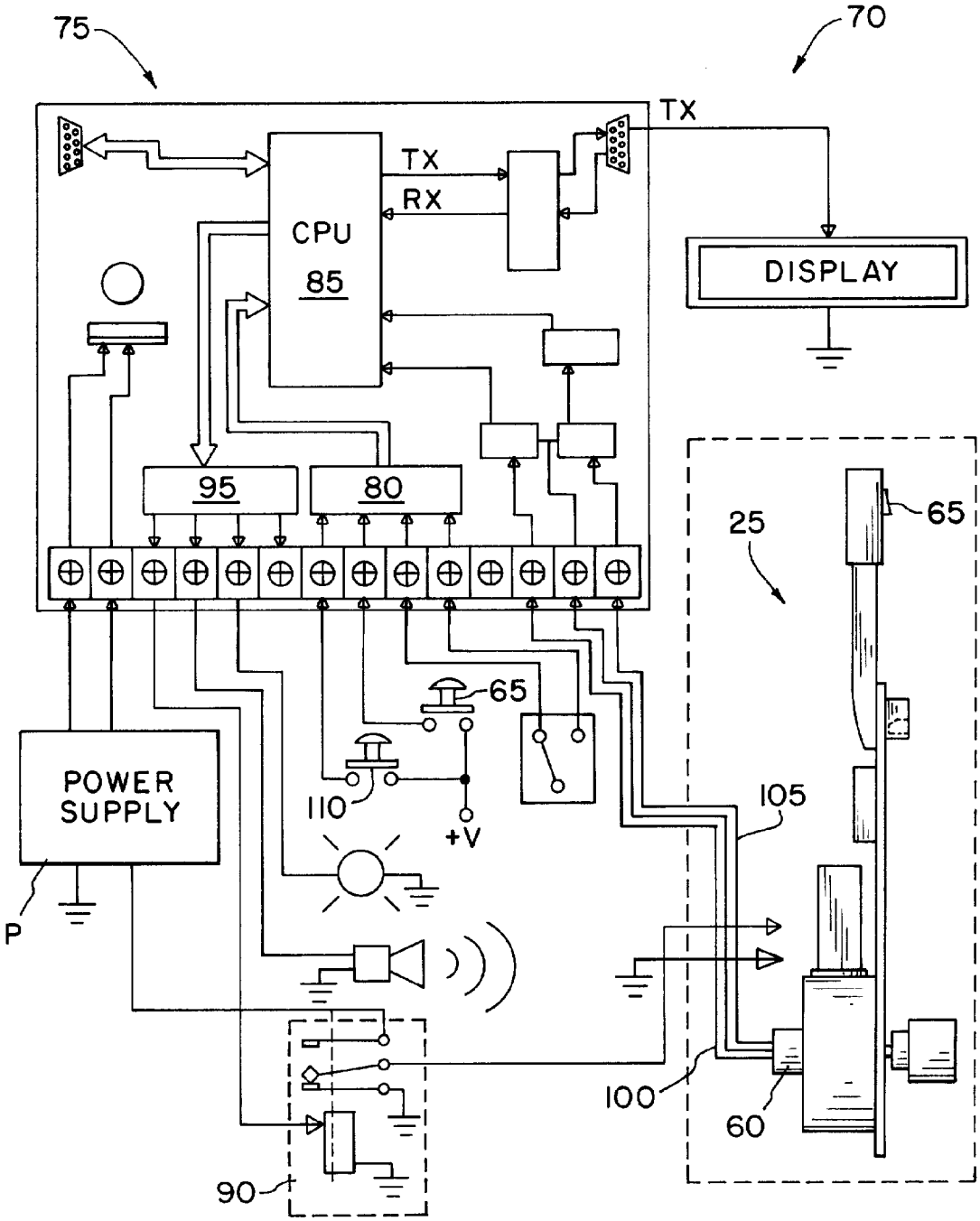
FIG. 3 schematically represents one exemplary control system for a precision crankshaft rotating apparatus of the present invention.

A schematic diagram of one exemplary electronic control system 70 that may be used to operate an apparatus of the present invention can be observed by reference to FIG. 3. For purposes of illustration, the control system 70 is shown and described in conjunction with the operation of the apparatus 25 of FIGS. 2*a*-2*b*.

In this exemplary control system embodiment 70, it can be seen that pressing the start button 65 on the apparatus 25 sends a positive voltage signal from a corresponding power supply P to an input of the controller 75. The signal may be conditioned by an optical isolator 80 and subsequently sent to an input of the controller's CPU 85.

When the CPU 85 receives a start signal, as described above, it energizes a motor control relay 90. The motor control relay 90 provides electric power to the motor/gearbox assembly 30, thereby causing the rotation of the drive element 35. The motor output signal may be conditioned by an optical isolator 95.

As the motor/gearbox assembly 30 rotates, the position sensor 60 (e.g., rotary encoder) is concurrently operated. The position sensor 60 monitors the angular position of the motor/gearbox assembly 30 and/or the drive element 35.

In this particular embodiment, the position sensor 60 includes two outputs 100, 105. A first position sensor output 100 produces some predetermined number of pulses per revolution (e.g., 360), while a second output produces a single pulse per revolution. The first output 100 is used to track the angular position of the motor/gearbox assembly 30 and/or the drive element 35. The second output 105 is used as a reference point for a zero or "home" position of the motor/gearbox assembly 30 and the drive element 35. Preferably, the motor/gearbox assembly 30 and the drive element 35 are automatically returned to the home position after each operation is completed. A reset button 110 may also be provided to manually cause the motor/gearbox assembly 30 and the drive element 35 to return to the home position.

Figure 4:
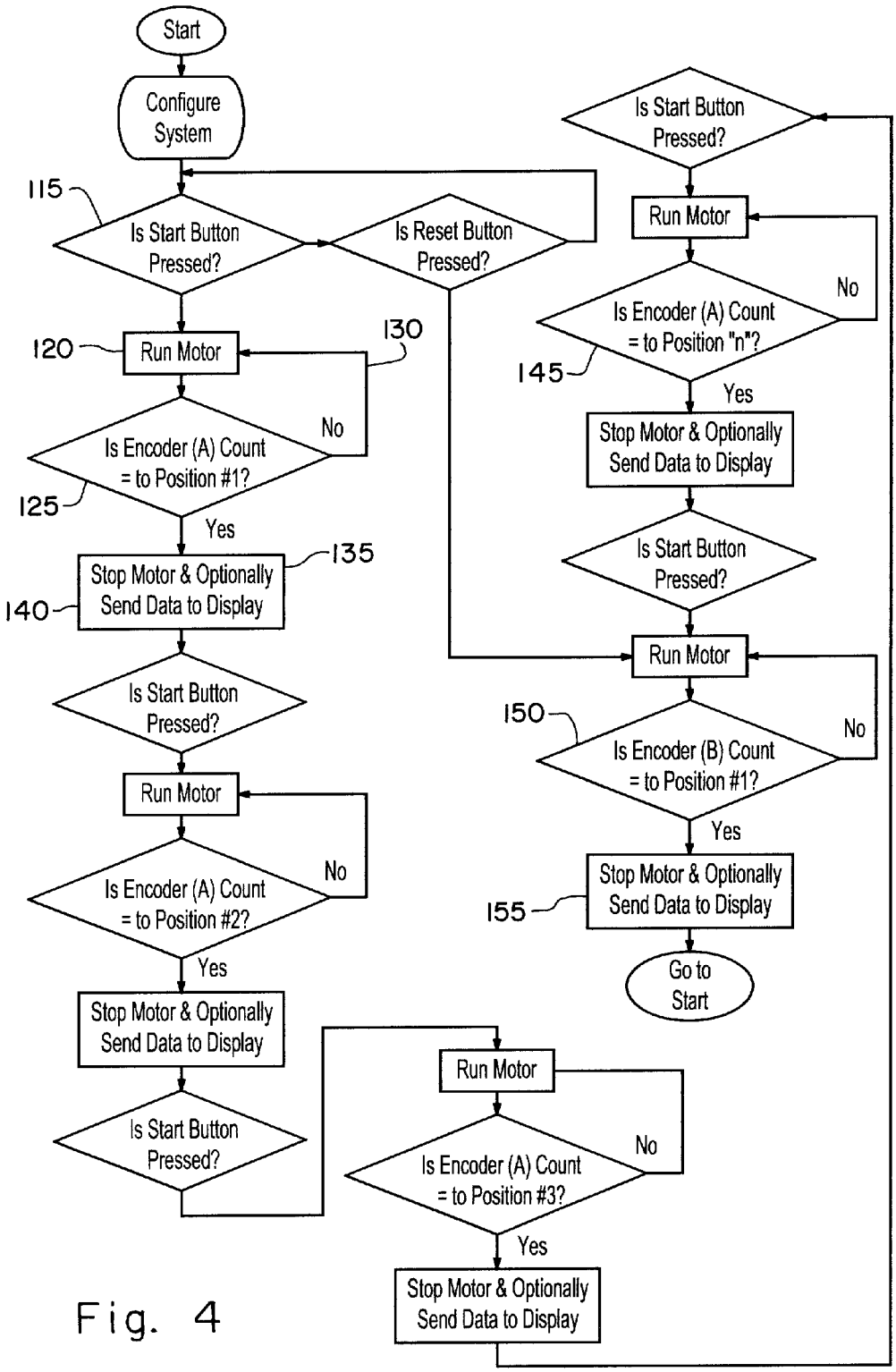
FIG. 4 is a flow diagram describing the exemplary operational steps of one method of operating an exemplary precision crankshaft rotating apparatus of the present invention.

Operation of an apparatus of the present invention using the control system 70 of FIG. 3 can be better understood by further reference to the flow diagram of FIG. 4 and the following description. In the exemplary operating scheme of FIG. 4, it can be seen that depression of the start button 115 causes the motor/gearbox assembly 30 and the drive element 35 to rotate a crankshaft of interest with which the drive element is engaged 120. As the crankshaft is rotated, the position sensor sends a number of associated pulses via the first output 100, which are received by and counted by the CPU 85 and its associated program(s). The CPU 85 compares the pulse count with a predetermined pulse count that corresponds to a first programmed angular position at which rotation of the crankshaft is to be stopped 125. If the sensed pulse count is less than the predetermined pulse count, operation of the motor/gearbox assembly 30 continues 130. If the sensed pulse count equals the predetermined pulse count, operation of the motor/gearbox assembly 30 is halted 135. A signal may also optionally be sent to a LCD, or some other visual and/or audible indicator may be activated to indicate the desired crankshaft angular position has been reached 140. In this particular example, the above steps are repeated each time the start button 65 is pressed—until the last of the programmed angular crankshaft positions n is reached 145.

Subsequent depression of the start button after the last of the programmed crankshaft angular positions n is reached, will result in the return of the motor/gearbox assembly 30 and the drive element 35 to the home position. As can be observed in FIG. 4, this is accomplished by having the CPU also monitor the second position sensor output and, after the last programmed angular crankshaft positions n is reached, rotating the motor/gearbox assembly 30 until the pulse count of the second output 105 reaches one. At this point, the controller 75 knows that the motor/gearbox assembly 30 and the drive element 35 are at the home position and, therefore, removes power from the motor 155. The apparatus is thus set for the next crankshaft rotation operation.

One particular application of an apparatus of the present invention is illustrated in FIG. 5. As shown, the portable apparatus 25 of FIGS. 2*a*-2*b* is suspended along an internal combustion assembly line 160. Consequently, this particular application involves use of the apparatus 25 in an engine assembly process. It should be realized, however, that apparatus of the present invention may also be used on already assembled engines, such as in the performance of repairs or maintenance.

In the exemplary embodiment of FIG. 5, the apparatus 25 is suspended from a lift-assist device 170 so as to facilitate its manipulation and use. In this case, the apparatus 25 is suspended at or near an area of the assembly line 160 where a valve tappet clearance setting operation is performed. As shown, engines 175 are transported on carriers 165 along the assembly line 160 past the location of the apparatus 25. Transport of the engines 175 may briefly cease when this position on the assembly line is reached, or transportation may continue (generally at a slow pace).

In any event, in order to perform the required valve tappet clearance setting operations, the crankshafts 180 of the engines 175 must be rotated some number of times so as to properly position the associated valves. For example, a crankshaft 180 may need to be rotated four separate times. As described above, the apparatus 25 can be used for this purpose in lieu of the manual technique illustrated in FIG. 1.

To use the apparatus 25 as illustrated in FIG. 5, an operator waits for an engine 175 to reach the proper position, and then draws the apparatus downward from its stored suspension point. The lift-assist device 170, while not essential to such an application, can decrease the amount of effort required to support and position the apparatus 25. As shown, the apparatus 25 is positioned in front of the engine by an operator (or by a robot or other automated actuator) so that the drive element 35 is approximately aligned with the crankshaft 180. The apparatus 25 is then moved toward the engine 175 until the drive element 35 engages the crankshaft 180 and the anti-rotation device 50 engages the corresponding carrier element E. With the apparatus 25 properly positioned, the start button 65 may be depressed and the crankshaft rotation operation can proceed as described above. Once the operation (e.g., valve tappet clearance setting) requiring crankshaft rotation is complete, the apparatus 25 may be removed from the engine 175 and returned to its stored position.

As would be apparent to those of skill in the art, non-portable embodiments of apparatus of the present invention may also be constructed and used. For example, a non-portable apparatus could replace the portable apparatus 25 shown in FIG. 5. Such an embodiment may reside along an assembly line or another area where engine crankshaft rotation is performed. In the embodiment of FIG. 5, for example, a non-portable version of an apparatus of the present invention could be located along the side of the assembly line. In such a case, the apparatus could be moved using an actuator, etc., into proper position to engage a crankshaft of interest. In yet other embodiments, the location and/or orientation of an apparatus may be fixed, and an engine and its associated crankshaft may be moved into and out of an engaged position with the apparatus.

As demonstrated by the illustrated examples and accompanying description, multiple variations of an apparatus of the present invention and its associated method of use are possible. Therefore, while certain exemplary embodiments and features of the present invention are described in detail above, the scope of the invention is not to be considered limited by such disclosure, and modifications are possible without departing from the spirit of the invention as evidenced by the following claims:

What is claimed is:

1. An apparatus for rotating a crankshaft of an internal combustion engine from a first angular position to a selected second angular position, comprising:

a body portion;

a motor attached to said body portion;

a drive element coupled to said motor, said drive element adapted to engage the crankshaft;

a position sensor arranged for monitoring the angular position of the crankshaft and producing an output based thereupon; and a controller in communication with the position sensor and the motor, the controller causing said motor to precisely rotate said crankshaft from the first to the second angular position in response to the output.

2. The apparatus of claim 1, further comprising a gearbox coupled to said motor.

3. The apparatus of claim 1, wherein said drive element is a socket.

4. The apparatus of claim 1, wherein said position sensor is a rotary encoder.

5. The apparatus of claim 4, wherein said rotary encoder produces a dual output, the first output providing a multitude of pulses per revolution, and the second output providing a single pulse per revolution.

6. The apparatus of claim 5, wherein said first output is used to monitor and control the angular position of said drive element and said second output is used to return said drive element to a home position.

7. The apparatus of claim 1, further comprising a handle.

8. The apparatus of claim 1, wherein said controller is affixed to said body portion.

9. The apparatus of claim 1, wherein said controller is located remotely from the remainder of said apparatus.

10. The apparatus of claim 1, further comprising an activation element for activating said motor.

11. The apparatus of claim 1, wherein said activation element is located on said handle.

12. The apparatus of claim 1, further comprising one or both of a visual and audible display.

13. The apparatus of claim 1, further comprising an anti-rotation element for preventing rotation of said apparatus during rotation of said drive element portion thereof.

14. A portable precision crankshaft rotating apparatus for rotating the crankshaft of an internal combustion engine, comprising:

a body portion;

a handle associated with said body portion;

a motor/gearbox assembly attached to said body portion; a drive element coupled to said motor/gearbox assembly, said drive element adapted to engage an exposed end of a crankshaft of an internal combustion engine;

an anti-rotation element for preventing rotation of said apparatus during rotation of said drive element portion thereof;

an activation element for energizing said motor/gearbox assembly and initiating the controlled rotation of said drive element;

a position sensor, said position sensor having a dual output, a first output providing a multitude of pulses per revolution and used to monitor and control the angular position of said drive element, and a second output providing a single pulse per revolution and used to return said drive element to a home position; and a programmed controller having a microprocessor, said controller in communication with said position sensor and said motor/gearbox assembly, and operative to cause said motor/gearbox assembly to sequentially rotate said crankshaft to a next preprogrammed angular position in response to each operation of said activation element.

15. The apparatus of claim 14, wherein said position sensor is a rotary encoder.

16. The apparatus of claim 14, further comprising one or both of a visual and audible display in electronic communication with said controller.

17. A method of precisely rotating a crankshaft, comprising:

providing a portable precision crankshaft rotating apparatus comprising:

a body portion, a motor/gearbox assembly attached to said body portion, a drive element coupled to said motor/gearbox assembly, said drive element adapted to engage an exposed end of the crankshaft, an anti-rotation element for preventing rotation of said apparatus during rotation of said drive element portion thereof;

a position sensor arranged to monitor the angular position of the crankshaft and product an output based thereupon; and a controller in communication with said position sensor and said motor/gearbox assembly, and operative to cause said motor/gearbox assembly to rotate said crankshaft to one or more desired angular positions in response to the output, locating said drive element of said portable precision crankshaft rotating apparatus to an exposed end of a crankshaft, and causing said controller to operate said motor/gearbox assembly to rotate said crankshaft to one or more desired angular positions.

18. The method of claim 17, further comprising providing said position sensor of said portable precision crankshaft rotating apparatus with a dual output, a first output providing a multitude of pulses per revolution and used to monitor and control the angular position of said drive element, and a second output providing a single pulse per revolution and used to return said drive element to a home position.

19. The method of claim 17, further comprising providing one or both of a visual and audible display in electronic communication with said controller of said portable precision crankshaft rotating apparatus.

20. The method of claim 17, further comprising supporting said portable precision crankshaft rotating apparatus from a lift-assist device to facilitate manipulation of said portable precision crankshaft rotating apparatus during use by an operator.

21. The method of claim 17, further comprising associating a handle with said body portion, said handle for facilitating manipulation of said apparatus by a user.

* * * * *